US009979088B2

(12) United States Patent
Bickford

(10) Patent No.: US 9,979,088 B2
(45) Date of Patent: May 22, 2018

(54) MECHANICAL ANTENNA

(71) Applicant: THE CHARLES STARK DRAPER LABORATORY, INC., Cambridge, MA (US)

(72) Inventor: James A. Bickford, Winchester, MA (US)

(73) Assignee: THE CHARLES STARK DRAPER LABORATORY, INC., Cambridge, MA (US)

( * ) Notice: Subject to any disclaimer, the term of this patent is extended or adjusted under 35 U.S.C. 154(b) by 92 days.

(21) Appl. No.: 15/011,926

(22) Filed: Feb. 1, 2016

(65) Prior Publication Data

US 2016/0226137 A1 Aug. 4, 2016

Related U.S. Application Data

(60) Provisional application No. 62/110,875, filed on Feb. 2, 2015.

(51) Int. Cl.
*H01Q 1/36* (2006.01)
*H01Q 9/04* (2006.01)

(52) U.S. Cl.
CPC ..... *H01Q 9/04* (2013.01)

(58) Field of Classification Search
CPC ..... H01Q 9/04
USPC ..... 343/897
See application file for complete search history.

(56) References Cited

U.S. PATENT DOCUMENTS 4,380,735 A 4/1983 Bell
4,670,092 A 6/1987 Motamedi
5,783,973 A 7/1998 Weinberg et al.
5,945,898 A 8/1999 Judy et al.
6,269,696 B1 8/2001 Weinberg et al.
6,670,809 B1 12/2003 Edelstein et al.
7,231,094 B2 6/2007 Bickford et al.
7,394,245 B2 7/2008 Brunson et al.
7,642,692 B1 1/2010 Pulskamp
7,972,888 B1 7/2011 Li et al.
8,674,689 B1 3/2014 Nielson et al.

FOREIGN PATENT DOCUMENTS

WO 2014025353 A1 2/2014
WO 2014205356 A2 12/2014

OTHER PUBLICATIONS

Williams et al., "Vacuum Steered-Electron Electric-Field Sensor", Journal of Microelectromechanical Systems, pp. 1-10, Jan. 15, 2013.

Ando et al., "E-Field Ferroelectric Sensor: Modeling and Simulation", IEEE Instrumentation & Measurement Magazine, pp. 31-37, 2009.

(Continued)

*Primary Examiner* — Graham Smith

(74) *Attorney, Agent, or Firm* — Lando & Anastasi, LLP

(57) ABSTRACT

Compact low-loss antennas and methods for long range two-way communication are provided. In one example, a mechanical antenna includes a first material having first embedded electric charge carriers, a second material having second embedded electric charge carriers, and an actuator coupled to at least one of the first material and the second material, the actuator being configured to generate a monopole current and transmit a low frequency signal by causing kinematic motion of the first material relative to the second material.

20 Claims, 5 Drawing Sheets

(56) References Cited

OTHER PUBLICATIONS

Bernstein et al., "Low-Noise MEMS Vibration Sensor for Geophysical Applications", Journal of Microelectromechanical Systems, vol. 8, No. 4, pp. 433-438, Dec. 1999.
Dilella et al., "A Micromachined Magnetic-Field Sensor Based on an Electron Tunneling Displacement Transducer", Sensors and Actuators, vol. 86, pp. 8-20, 2000.
Dong et al., "Push-Pull Mode Magnetostrictive/Piezoelectric Laminate Composite with an Enhanced Magnetoelectric Voltage Coefficient", Applied Physics Letters, vol. 87, p. 62502, 2005.
Gabrielson, T.B., "Mechanical-Thermal Noise in Micromachined Acoustic and Vibration Sensors", IEEE Transactions on Electron Devices, vol. 40, No. 5, pp. 903-909, May 1993.
Kyynarainen et al., "A 3D Micromechanical Compass", Sensors and Actuators A, vol. 142, pp. 561-568, 2008.
Latorre et al., "Micromachined CMOS Magnetic Field Sensor with Ferromagnetic Actuation", Proceedings of SPIE, vol. 4019, 2000.
Tatarchuk et al., "A MEMS DC Current Sensor Utilizing Neodymium Rare Earth Magnets," Advancing Microelectronics, pp. 6-10, Jan. 2015.
Vasquez, D., and J. Judy, "Optically-Interrogated Zero-Power MEMS Magnetometer", Journal of Microelectromechanical Systems, vol. 16, No. 2, pp. 336-343, Apr. 2007.
Wickenden et al., "Polysilicon Xylophone Bar Magnetometers", SPIE, vol. 3876, pp. 267-273, Sep. 1999.
Yang et al., "Ferromagnetic Micromechanical Magnetometer", Sensors and Actuators A, vol. 97-98, pp. 88-97, 2002.
Zhao et al., "Fabrication and Characterization of All-Thin-Film Magnetoelectric Sensors", Applied Physics Letters, vol. 94, p. 243507, 2009.
Angelakis et al., "EEG Neurofeedback: A Brief Overview and an Example of Peak Alpha Frequency Training for Cognitive Enhancement in the Elderly", The Clinical Neuropsychologist, vol. 21, pp. 110-129, Feb. 16, 2007.
Ashrafulla, S., "EEG and MEG: functional brain imaging with high temporal resolution", Jun. 2013, <URL: <https://ngp.usc.edu/files/2013/06/Syed_EEG_MEG.pdf>.
Basar et al., "A review of brain oscillations in cognitive disorders and the role of neurotransmitters", Brain Research, vol. 1235, pp. 172-193, Jul. 2, 2008.
Bogue, R., "Plessey launches range of unique electric field sensors", Sensor Review, vol. 32, No. 3, pp. 194-198, 2012.
Toney et al., "Detection of Energized Structures with an Electra-Optic Electric Field Sensor", IEEE, pp. 1364-1369, May 2014.
Choi, K., "Electroencephalography (EEG) based neurofeedback training for brain-computer interface (BCI)", pp. 1-26, Sep. 2013.
Datskos et al., "Using Micro-Electro-Mechanical Systems (MEMS) as Small Antennas", IEEE, 2012.
Grummett et al., "Measurement of neural signals from inexpensive, wireless and dry EEG systems", Physiological Measurement, vol. 36, pp. 1469-1484, 2015.
Heintzelman et al., "Characterization and Analysis of Electric-field Sensors", IEEE, Dec. 17, 2015.
Huang et al., "A novel high-sensitivity electrostatic biased electric field sensor", Journal of Micromechanics and Microengineering, vol. 25, pp. 1-9, Aug. 17, 2015.
Kingsley et al., "Photrodes for physiological sensing", SPIE 5317, Optical Fibers and Sensors for Medical Applications IV, Jun. 2004.
Miles et al., "Report on Non-Contact DC Electric Field Sensors", Jun. 23, 2009.
Niv, S., "Clinical efficacy and potential mechanisms of neurofeedback", Personality and Individual Differences, vol. 54, pp. 676-686, Jan. 24, 2013.
Othmer, S., "Neuromodulation technologies: An attempt at classification", Introduction to Quantitative EEG and Neurofeedback: Advanced Theory and Applications, second edition, pp. 1-27, 2009.
Petrov et al., "Electric Field Encephalography as a Tool for Functional Brain Research: A Modeling Study", PLOS One, vol. 8, No. 7, Jul. 3, 2013.
Prance, H., "Sensor Developments for Electrophysiological Monitoring in Healthcare", Applied Biomedical Engineering, pp. 265-286, Aug. 2011.
Schalk et al. "Brain Sensors and Signals", A Practical Guide to Brain-Computer Interfacing with General-Purpose Software for Brain-Computer Interface Research, Data Acquisition, Stimulus Presentation, and Brain Monitoring, pp. 9-35, 2010.
Stikic et al., "Modeling temporal sequences of cognitive state changes based on a combination of EEG-engagement, EEG-workload, and heart rate metrics", Frontiers in Neuroscience, vol. 8, article 342, pp. 1-14, Nov. 2014.
Sinha et al., "Electromagnetic Radiation Under Explicit Symmetry Breaking", Physical Review Letters, vol. 114, pp. 1-7, Apr. 2015.
Sinha et al., "Sinha and Amaratunga Reply", Physical Review Letters, vol. 115, pp. 1-2, Sep. 2015.
Simovski et al., "Comment on 'Electromagnetic Radiation Under Explicit Symmetry Breaking", Physical Review Letters, vol. 115, p. 1, Sep. 2015.
Kao, K.C., "Dielectric Phenomena in Solids", Elsevier, pp. 283-326, 2004.
Hansen et al., "VLF Cutler: Sep. 1997 Four-Panel Tests; RADHAZ and Field Strength Measurement", SPAWAR Technical Report 1761, Jan. 1998.
Teller, E., "Electromagnetism and Gravitation", Proc. Natl. Acad. Sci. USA, vol. 74, No. 7, pp. 2664-2666, Jul. 1977.
Weldon et al., "Nanomechanical Radio Transmitter", Physica Status Solidi (b), vol. 245, No. 10, pp. 2323-2325, Sep. 2008.
Yao et al., "Bulk Acoustic Wave-Mediated Multiferroic Antennas: Architecture and Performance Bound", IEEE Transactions on Antennas and Propagation, vol. 63, No. 8, pp. 3335-3344, Aug. 2015.
Nawrodt et al., "High Mechanical Q-factor Measurements on Silicon Bulk Samples", Journal of Physics: Conference Series, vol. 122, 2008.
Leonov et al., "Charge Retention in a Patterned SiO2/Si3N4 Electret", IEEE Sensors Journal, vol. 13, No. 9, pp. 3369-3376, Sep. 2013.
Kamel et al., "Poling of Hard Farroelectric PZT Ceramics", Journal of the European Ceramic Society, vol. 28, pp. 1827-1838, Mar. 2008.
Kelly et al., "Progress Toward Forecasting of Space Weather Effects on UHF SATCOM After Operation Anaconda", Space Weather, vol. 12, pp. 601-611, Oct. 2014.

MECHANICAL ANTENNA

CROSS-REFERENCE TO RELATED APPLICATIONS

This application claims priority under 35 U.S.C. § 119(e) to U.S. Provisional Application Ser. No. 62/110,875, titled "MECHANICAL ANTENNA," filed on Feb. 2, 2015, which is hereby incorporated herein by reference in its entirety.

BACKGROUND

Low frequency electromagnetic systems have a wide variety of applications, such as radio communication and navigation, as well as various medical, meteorological and military applications. In particular, low frequency systems are often used to communicate information to or from a system that is enclosed by a conducting material, for example, salt water, metal containers, buildings, soil, tissue, and so forth. A conductive material that intercepts the source will generate eddy currents that oppose the impinging field. Traditional radio frequency systems are generally not capable of supporting these types of applications since radio frequency ("RF") signals (in the Mhz-GHz frequency range) cannot penetrate even a moderate thickness of a surrounding conductor. Accordingly, low frequency electromagnetic systems offer a way to penetrate these barriers for communication and localization in what would ordinarily be considered a denied environment.

Traditional RF signals are typically line-of-sight signals and require a satellite link for long range operation. However, satellites are not always reliable, especially in wartime situations where they may be jammed or otherwise unavailable. In comparison, operating in the medium frequency band ("MF") (0.3 MHz-3.0 MHz), and below, enables propagation over long distances assisted by refraction from the Earth's ionosphere. This principle can leverage signals in the very-low frequency band (3.0 kHz-30.0 kHz) to enable worldwide communications.

SUMMARY OF THE INVENTION

Aspects and embodiments relate generally to low frequency transceivers, and more specifically to compact low-loss transceivers allowing for long range two-way communication with portable equipment. Various embodiments provide for a low loss mechanical antenna that produces currents and inductive fields. In one example, the mechanical antenna includes a first charged material and a second charged material, and is configured to transmit or receive signals in a frequency wavelength range of 1 Hz-100 kHz by kinematic motion of the first and second charged material relative to each other.

According to one aspect, provided is a mechanical antenna. In one example, the antenna includes a first material having first embedded electric charge carriers, a second material having second embedded electric charge carriers, and an actuator coupled to at least one of the first material and the second material, the actuator being configured to generate a monopole current and transmit a low frequency signal by causing kinematic motion of the first material relative to the second material.

In an embodiment, the actuator includes one of an electrostatic source, an electromagnetic source, a pneumatic source, a hydraulic source, and a seismic source, the actuator being further configured to displace the first material in a first linear direction relative to the second material. In one embodiment, the actuator is further configured to displace the second material in a second linear direction relative to the first material, and the second linear direction is substantially opposite to the first linear direction. According to an embodiment, the actuator includes one of an electrostatic source, an electromagnetic source, a pneumatic source, a hydraulic source, and a seismic source, and in causing kinematic motion of the first material relative to the second material, the actuator is configured to rotate the first material relative to the second material.

According to one embodiment, the antenna further includes at least one sensor positioned to measure movement of the mechanical antenna, and a controller in electrical communication with the actuator and the sensor, the controller being configured to induce the actuator to displace the first material in a first linear direction relative to the second material responsive to receiving a sensor signal from the sensor. In an embodiment, the actuator is further configured to cause the kinematic motion of the first material relative to the second material to generate the monopole current responsive to receiving a baseband seismic input from one or more seismic sources.

In an embodiment, the first material includes a first highly resistive dielectric and the second material includes a second highly resistive dielectric, and each of the first highly resistive dielectric and the second highly resistive dielectric include an electret. According to one embodiment, the first material and the second material are non-contiguous. In one embodiment, each of the first material and the second material are further configured to mechanically match an impedance of the mechanical antenna and an impedance of system electronics coupled to the mechanical antenna. According to an embodiment, the low frequency signal includes a baseband signal having a wavelength within a frequency wavelength range of 1 Hz-100 kHz.

According to one aspect, provided is a mechanical antenna. In one example, the antenna includes a plurality of first materials each having first embedded electric charge carriers, a plurality of second materials each having second embedded electric charge carriers, the plurality of first materials and the plurality of second materials being stacked so as to alternate between the first materials and the second materials, and an actuator coupled to at least a subset of first materials of the plurality of first materials, the actuator being configured to generate a monopole current and transmit a low frequency signal by causing kinematic motion of the subset of first materials relative to the plurality of second materials.

In an embodiment, the actuator includes one of an electrostatic source, an electromagnetic source, a pneumatic source, a hydraulic source, and a seismic source, the actuator being further configured to displace the subset of first materials in a first linear direction relative to the plurality of second materials. In a further embodiment, the actuator is further coupled to at least a subset of second materials of the plurality of second materials, and the actuator being further configured to displace the subset of second materials in a second linear direction relative to the plurality of first materials, and the second linear direction is substantially opposite the first linear direction.

According to an embodiment, the actuator is further configured to selectively displace individual ones of the subset of first materials. In one embodiment, each first material of the plurality of first materials includes a first highly resistive dielectric and each second material of the plurality of second materials includes a second highly resistive dielectric, and each of the first highly resistive dielectric and the second highly resistive dielectric includes an electret.

According to another aspect, provided is method for communication. In one example, the method includes displacing a first material having first embedded electric charge carriers relative to a second material having second embedded electric charge carriers, generating a monopole current responsive to displacement of the first material, and transmitting a low frequency signal based at least in part on the monopole current.

In an embodiment, displacing the first material relative to the second material includes displacing the first material in a first linear direction with an actuator coupled to the first material. In a further embodiment, the method includes displacing the second material relative to the first material in a second linear direction, and the second linear direction is substantially opposite to the first linear direction. In one embodiment, displacing the first material relative to the second material includes rotating the first material relative to the second material, and the first material is a first highly resistive dielectric and the second material is a second highly resistive dielectric. According an embodiment, transmitting the low frequency signal further includes transmitting a baseband signal having a wavelength within a frequency range of 1 Hz-100 kHz.

According to another aspect, provided is a mechanical antenna. In one example, the antenna includes a first material having embedded charge carriers, and a second material having embedded charge carriers, and the first and the second material are configured to generate a monopole current through kinematic motion relative to each other. In one embodiment, the first material includes a first highly resistive dielectric and the second material includes a second highly resistive dielectric. In a further embodiment, the first and second dielectrics each include an electret. In another embodiment, the first and/or second materials include a capacitor. According to one embodiment, the antenna is characterized by the absence of a return current path.

According to another aspect, provided is a mechanical antenna. In one example, the antenna includes a plurality of stacked materials having embedded charge carriers, and the plurality of stacked materials is configured to generate a monopole current through kinematic motion of a subset of the plurality of stacked materials relative to the plurality of stacked materials.

In another aspect, provided is a method of transmitting electromagnetic energy. In one example, the method includes generating a monopole current source by kinematic motion of a first highly resistive dielectric embedded with charge carriers relative to a second highly resistive dielectric embedded with charge carriers.

According to another aspect, provided is a method of receiving electromagnetic energy. In one example, the method includes receiving a signal having an associated electromagnetic field, generating a mechanical force in an antenna having a first highly resistive dielectric embedded with charge carriers and a second highly resistive dielectric embedded with charge carriers, and generating the mechanical force includes imparting the electromagnetic field on the embedded charge carriers in the first and second dielectrics, and measuring the generated mechanical force.

In still another aspect, provided is a mechanical antenna. In one example, the method includes a first material having embedded charge carriers and a second material having embedded charge carriers, and the first and the second material are configured to generate a magnetic dipole through rotational motion relative to each other.

Still other aspects, embodiments, and advantages of these exemplary aspects and embodiments are discussed in detail below. Embodiments disclosed herein may be combined with other embodiments in any manner consistent with at least one of the principles disclosed herein, and references to "an embodiment," "some embodiments," "an alternate embodiment," "various embodiments," "one embodiment" or the like are not necessarily mutually exclusive and are intended to indicate that a particular feature, structure, or characteristic described may be included in at least one embodiment. The appearances of such terms herein are not necessarily all referring to the same embodiment.

BRIEF DESCRIPTION OF THE DRAWINGS

Various aspects of at least one embodiment are discussed below with reference to the accompanying figures, which are not intended to be drawn to scale. The figures are included to provide illustration and a further understanding of the various aspects and embodiments, and are incorporated in and constitute a part of this specification, but are not intended as a definition of the limits of the invention. In the figures, each identical or nearly identical component that is illustrated in various figures is represented by a like numeral. For purposes of clarity, not every component may be labeled in every figure. In the figures.

DETAILED DESCRIPTION

Figure 1:
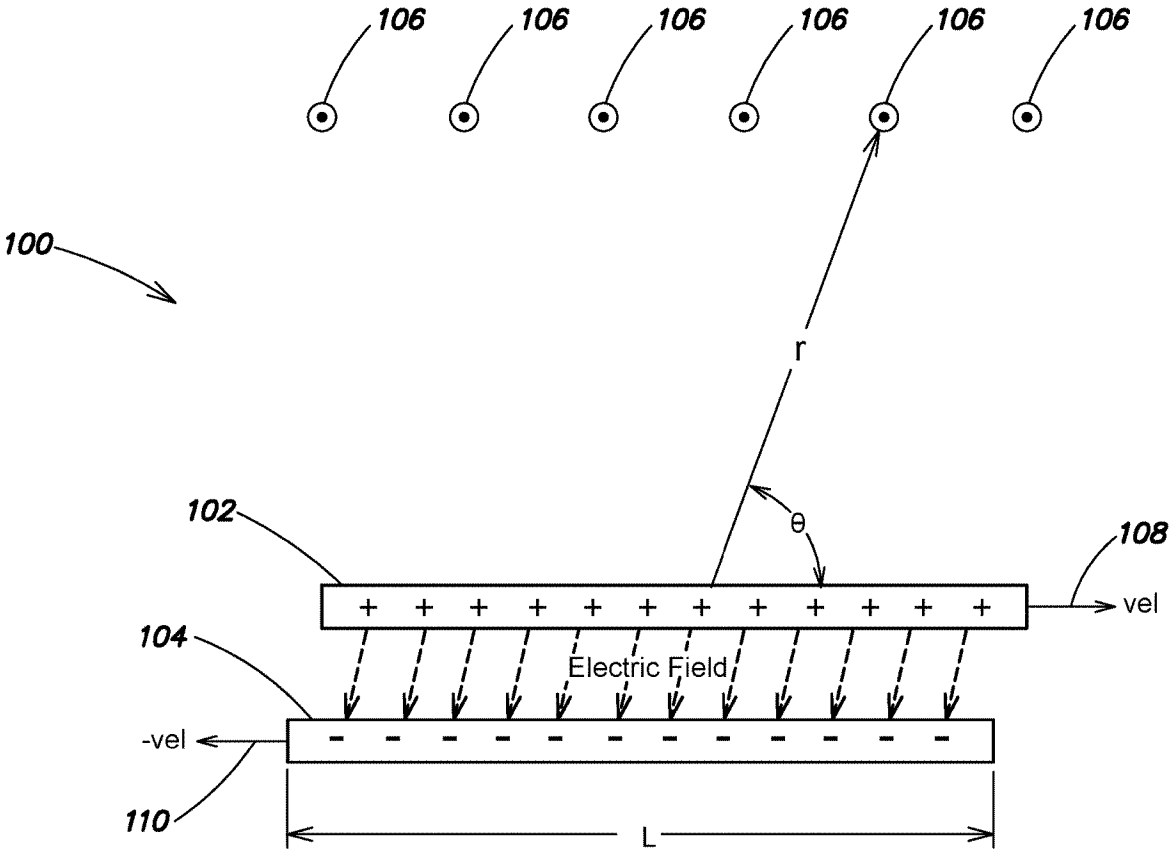
FIG. 1 is a schematic diagram illustrating one example of electromagnetic energy transmission using a mechanical antenna, according to aspects of the present invention.

Aspects and embodiments relate generally to low frequency transceivers, and more specifically to compact low-loss transceivers allowing for long range two-way communication with portable equipment. Various embodiments provide for a low loss mechanical antenna that produces currents and inductive fields. In various embodiments, the mechanical antenna is configured to transmit or receive signals in a frequency wavelength range of 1 Hz-100 kHz; however, it is appreciated that in additional embodiments the antenna may transmit or receive signals in higher frequency bands.

Conventional low frequency transmitters are often very large or inefficient due to the long wavelengths inherent to low frequency signals. For example, some communication stations require assets up to a kilometer (km) in length to obtain an appropriate wavelength-to-antenna length ratio. Understandably, antennas longer than 1 km are not practical in most military or mobile applications. While magnetic coils allow for more compact low frequency antennas, the return current path of the magnetic coil impacts the propagation of the signal dramatically, and significantly limits the efficiency of the antenna.

Accordingly, there is a need for an efficient compact antenna capable of transmitting low frequency signals without the significant losses that conventional compact antennas suffer. Certain aspects and embodiments discussed herein permit long range low frequency transmissions without the dimensional or inefficiency disadvantages of conventional transmission and reception techniques.

In various embodiments, electromagnetic energy is transmitted by generating a monopole current source with kinematic motion of a first high resistive dielectric embedded with electric charge carriers relative to a second highly resistive dielectric embedded with charge carriers. This arrangement may be used to transmit a low frequency signal to a distally located receiver. For example, a magnetometer, or other electromagnetic sensor, may be used to detect an electromagnetic field, field variations, or field characteristics at a location of reception. In other examples, kinematic motion of a first highly resistive dielectric embedded with electric charge carriers relative to a second highly resistive dielectric embedded with electric charge carriers is used to receive a signal. The received signal, having an associated electromagnetic field, generates a mechanical force on the embedded charges within the one or more highly resistive dielectrics. Measurement of the resulting mechanical force may be used to interpret the received signal. Accordingly, arrangements according to various aspects and embodiments may be used to transmit or receive low frequency signals (or high frequency signals) and overcome the propagation losses suffered by conventional compact magnetic coil antennas.

Embodiments of the mechanical antenna, systems, and methods, disclosed herein may have applications in various fields, such as radio communication and navigation, as well as, various medical, meteorological and military applications. Such embodiments may be particularly advantageous for long range military applications. As further discussed below, embodiments may be used to communicate information to, or from, a system that is enclosed by a conducting material, for example, salt water, metal containers, buildings, soil, and/or tissue. For example, embodiments may be used to enable long range, portable transmission for secure and hardened theater level communications, and provide for a navigation system that does not require a satellite (e.g., GPS) infrastructure. Other examples of embodiments include small covert low frequency transceivers and collection systems for various data exfiltration missions.

It is to be appreciated that embodiments of the methods and apparatuses discussed herein are not limited in application to the details of construction and the arrangement of components set forth in the following description or illustrated in the accompanying drawings. The methods and apparatuses are capable of implementation in other embodiments and of being practiced or of being carried out in various ways. Examples of specific implementations are provided herein for illustrative purposes only and are not intended to be limiting. In particular, acts, elements and features discussed in connection with any one or more embodiments are not intended to be excluded from a similar role in any other embodiment. Also, the phraseology and terminology used herein is for the purpose of description and should not be regarded as limiting. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms. Any references to front and back, left and right, top and bottom, upper and lower, and vertical and horizontal are intended for convenience of description, not to limit the present systems and methods or their components to any one positional or spatial orientation.

Turning to FIG. 1, there is illustrated schematic diagram showing one example of electromagnetic energy transmission using a mechanical antenna, according to various aspects and embodiments. As shown, the antenna 100 includes a first material 102 having a first embedded electric charge carrier (shown as +), and a second material 104 having a second embedded electric charge carrier (shown as −). The first material 102 and the second material 104 each have an associated length, width, and height. The length of each material is generally shown in FIG. 1 as "L". Physical (i.e., kinematic) movement of the first material 102, and consequent movement of the charge trapped therein, is equivalent to a line current that generates a surrounding magnetic field. In FIG. 1, the surrounding field is modeled by the equation, $$B = \mu_0\left(\frac{IL\sin(\theta)}{4\pi r^2}\right) \tag{1}$$

where, $$I = vel\left(\frac{q}{L}\right). \tag{2}$$

In equation (1) and equation (2), "B" represents the magnetic field, "$\mu_0$" represents the magnetic permeability, "I" represents the intensity of the electrical current, "q" represents the total surface charge, "vel" represents a velocity, "θ" represents an angular relation to the magnetic field, and "r" represents the range from the first material 102. The magnetic field is represented in FIG. 1 by directional indicators 106. Physical movement of the first material 102 (shown at the velocity, "vel"), and/or physical movement of the second material 104, does not create a return current path (as would be the case in a conventional magnetic coil). Accordingly, physical movement of the first material 102 relative to the second material 104 generates the monopole current. In response to generation of a monopole current, the mechanical antenna 100 may send and/or receive electromagnetic energy, and for example, transmit a low frequency signal.

In various embodiments, the field from the fixed asymmetric distribution of charge in the first material 102, and the second material 104, is purely electrostatic since it persists as a non-time varying and stationary charge distribution. However, kinematic movement of such a structure induces kinematic motion of the charge in the first material 102, which is otherwise immobilized. Accordingly, the kinematic motion of charge which is immobilized in the first material 102 can produce line and loop electric currents.

In particular, equation (2) is representative of an isolated charge of a single polarity moving in a single linear direction. Accordingly, in various embodiments kinematic motion of the second material 104, having electric charge carriers opposite in charge to those of the first material 102, in a second direction opposite the first direction, will effectively double the realized current since, $$(q)(\text{vel})=(-q)(-\text{vel}). \tag{3}$$

That is, while in one embodiment the first material 102 is positioned to move relative to the second material 104 in a first direction (e.g., a first linear direction), in various embodiments, the second material 104 may be positioned to move relative to the first material in a substantially opposite second direction (e.g., a second linear direction). For example, in various embodiments the first material 102 and second material 104 are positioned such that they may be moved in substantially opposite linear directions simultaneously. In particular, FIG. 1 illustrates movement of the first material 102 in a first direction (indicated by arrow 108) at the velocity, "vel", and movement of the second material 104 in a substantially opposite second direction (indicated by arrow 110) at a similar opposite velocity "−vel".

Although shown in FIG. 1 as kinematic motion in a linear direction, in various implementations movement of the first material and/or second material may include rotation or separation of the first and second materials 102, 104 to move the respective imbedded electric charge carriers in opposite directions. For instance, rotation of the first material 102 about an axis substantially aligned with the second material 104 (e.g., extending through a length of the second material 104) may similarly generate a monopole current. In various other implementations, rotation of the second material 104 relative to the first material in a similar fashion will also generate a monopole current source. Rotation, as discussed herein, may be deconstructed into two orthogonal linear motions, each of which may be caused, for example, by a component of the antenna 100. For example, rotation movement may be caused by an actuator such as the actuator 206 discussed with reference to FIG. 2.

Furthermore, FIG. 1 shows the first material 102 and second material 104 contiguous, or in otherwise close proximity. However, in some embodiments the first and second materials 102, 104 may be non-contiguous and disposed at any distance apart necessary for inclusion of the mechanical antenna 100 in a communication system. It is appreciated that a non-contiguous first and second material 102, 104 permit a "deconstructed" mechanical antenna capable of placement in locations conventional antennas physically cannot reside.

While described above as configured to generate a monopole current through kinematic motion of the first material 102 relative to the second material 104, in various embodiments, rotational movement of the first material 102 relative to second material 104 will generate a current in opposite directions. Accordingly, in another embodiment, the first material 102 may be rotated relative to the second material 104 to generate a magnetic dipole. The resulting magnetic field may be used to transmit or receive low frequency signals.

As described above, in one embodiment the antenna 100 includes a first material 102 and a second material 104, the first material 102 having embedded electric charge carriers substantially opposite in charge to the embedded electric charge carriers of the second material 104. For example, each material 102, 104 can include a highly resistive dielectric, such as an electret. As used herein, the term "electrets" refers to the dielectric equivalent of a permanent magnet. For example, an electret configured for use in the mechanical antenna 100 of FIG. 1 may be formed by: (a) applying heat to an electret material, (b) in response to obtaining a predetermined temperature, applying a voltage to the electret material (at which point the electret material acts like a capacitor and stores the applied charge), and (c) cooling the electret material to a second predetermined temperature.

Thereafter, the electret maintains the desired residual embedded electric charge. As an additional example, the electret material may be bombarded with radiation to create a desired residual charge. Accordingly, real surface charges or aligned dipoles are immobilized in the bulk of the dielectric material. In an additional embodiment, the first material 102 includes a first capacitor plate, and the second material 104 includes a second capacitor plate. Similarly, kinematic movement of the first capacitor plate relative to the second capacitor plate may generate a monopole current flow. As shown in FIG. 1, each of the first material 102 and the second material 104 may include an electret fabricated as separate plate, each being independently actuatable.

For purposes of further illustration, and with continuing reference to equations (1) and (2), in spherical coordinates the magnetic field ($B_\theta$), at a range (r) and an angle (θ) from the current axis on the mechanical antenna 100, may be represented as, $$B_\theta = \left(\frac{\mu_0 I_e dl}{4\pi}\right)\sin(\theta)\left(\frac{j\beta}{r} + \frac{1}{r^2}\right)(e^{-j\beta r}) \tag{4}$$

where, $\beta=2\pi/\lambda$. All other components of the magnetic field are zero. Accordingly, in various embodiments, the non-zero electric field components ($E_r$) and ($E_\theta$) may be represented as, $$E_r = \left(\frac{\eta I_e dl}{2\pi}\right)\cos(\theta)\left(\frac{1}{r^2} + \frac{j}{\beta r^3}\right)(e^{-j\beta r}) \tag{5}$$

and, $$E_\theta = \left(\frac{\eta I_e dl}{4\pi}\right)\sin(\theta)\left(\frac{j\beta}{r} + \frac{1}{r^2} - \frac{j}{\beta r^3}\right)(e^{-j\beta r}) \tag{6}$$

where, $$\eta = \sqrt{\frac{\mu}{\varepsilon}}. \tag{7}$$

The $1/r^2$ terms represent the electrostatic field since it is derived from an induced electric dipole. The 1/r term dominates in the far field (radiation field) which is the domain of traditional RF. Therefore, in contrast to conventional magnetic antennas, which scale at a rate of $1/r^3$ as the distance from the source is increased, various aspects and embodiments scale at a rate of $1/r^2$. This translates to higher field levels in the near field, and improved coupling in the far field.

Figure 2A:
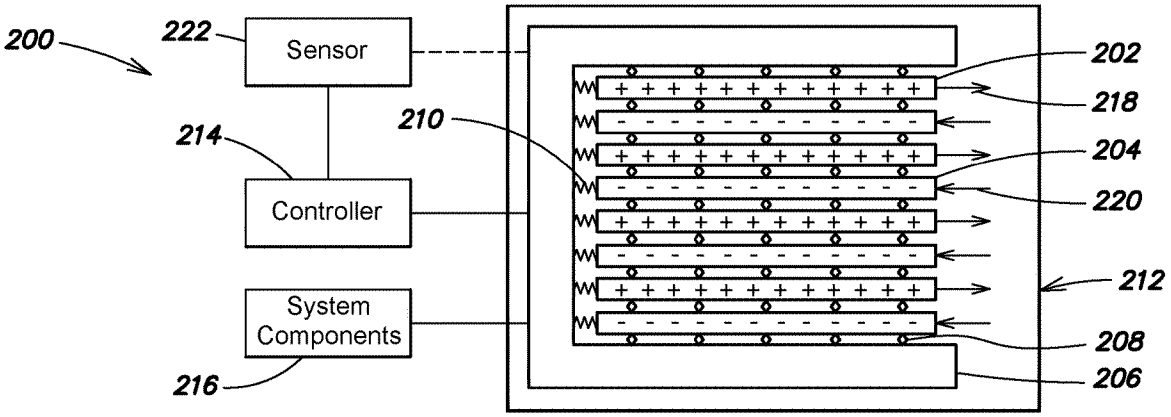
FIG. 2A is a top-view illustration of one example of a mechanical antenna, which can be used to transmit and receive electromagnetic energy, according to aspects of the present invention.
Figure 2B:
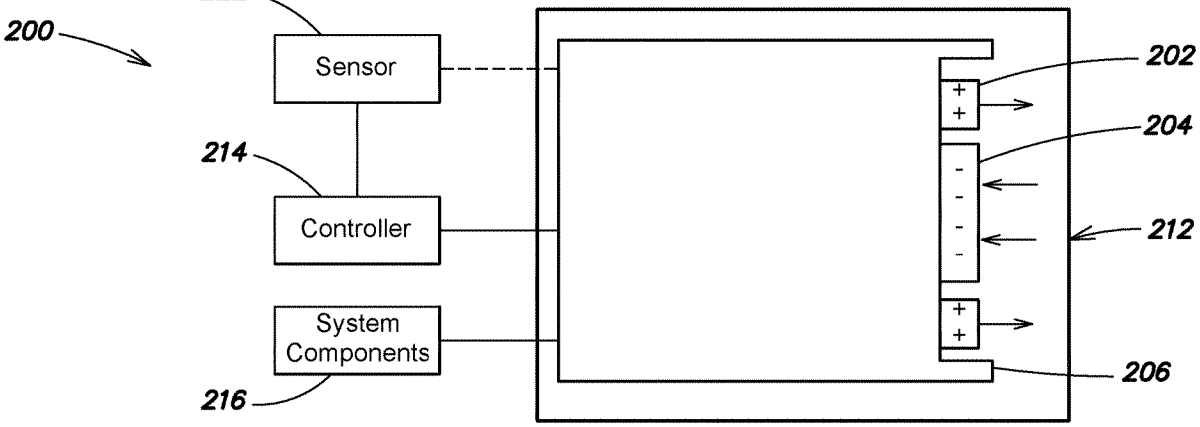
FIG. 2B is a side-view illustration of the exemplary mechanical antenna of FIG. 2A, which can be used to transmit and receive electromagnetic energy according to aspects of the present invention.

Turning now to FIG. 2A and FIG. 2B, there is illustrated one example of a mechanical antenna 200 according to various aspects and embodiments. FIG. 2A shows a top view of the antenna 200. As shown, the antenna 200 may include a plurality of first materials 202 and a plurality of second materials 204. Each first material 202 and each second material 204 includes embedded electric charge carriers. For example, each first material 202 may include a first embedded electric charge carrier, similar to the first material 102 shown in FIG. 1, and each second material 204 can include a second embedded electric charge carrier, similar to the second material 104 shown in FIG. 1. In order to increase the magnitude of kinematic induced current in the antenna 200, micron thick layers of the first and second materials 202, 204 may be stacked. For instance, FIG. 2A shows alternating layers of the first material 202 and second material 204 stacked in a vertical orientation.

Although each first material 202 and each second material 204 may include various types of material, the materials 202, 204 of one embodiment can include electrets or capacitors. For instance, the antenna 200 may include multiple layers of stacked electrets plates or capacitor plates. Regarding the use of electrets, the electret plates of various embodiments may include a single electret physically split in two in order to facilitate the desired movement. That is, in various embodiments, the first material 202 may include a first portion of an electret, and the second material 204 may include the remaining portion of the same electret. The immobilized charge of the first and second materials 202, 204 is stationary relative to the highly resistive dielectric it is moving with, so, traditional resistive losses are not present in various embodiments. In one example, electrets may be formed so as to stack a large number, e.g., hundreds, or thousands, in one mechanical antenna, while still maintaining a compact profile. For example, in one embodiment each of the first material 202 and second material 204 may have a thickness of approximately 10 microns.

FIG. 2A also shows an actuator 206, optionally including elastic structures 210 (e.g., springs), coupled to the plurality of first materials 202, and plurality of second materials 204. In various embodiments, the actuator 206 is configured to actuate displacement of the materials 202, 204. In an embodiment, the actuator 206 is configured to initiate kinematic motion of a selected subset of the plurality of first materials 202, or a selected subset of the plurality of second materials 204. Individual ones of the plurality of materials 202, 204 may be configured to be independently selected and actuated (e.g., displaced), or selected and actuated in predetermined groups. For example, FIG. 2A shows kinematic motion of all of the plurality of first materials 202.

In certain embodiments, the actuator 206 can be additionally configured to actuate a subset of the plurality of second materials 204 in an opposite direction to that of movement of the subset of first materials 202. For instance, FIG. 2A illustrates movement of the plurality of first materials 202 in a first direction (indicated by arrow 218), and movement of the subset of the plurality of second materials 204 in a substantially opposite direction (indicated by arrow 220). As shown, in certain embodiments the antenna 200 may include a plurality of Teflon particles 208 interposed between the plurality of first materials 202 and second materials 204 to facilitate fluid movement. FIG. 2A additionally shows a mechanical antenna housing 212 substantially enclosing the actuator 206 and the plurality of first materials 202 and second materials 204. In one embodiment, the mechanical antenna housing 212 includes a vacuum chamber for vacuum sealing the mechanical antenna 200. Vacuum sealing the mechanical antenna 200 reduces losses as a result of air damping. FIG. 2B shows a side view of the mechanical antenna 200 shown in FIG. 2A. Similar to the embodiments discussed above with reference to FIG. 1, in some embodiments the plurality of first materials 202 and the plurality of second materials 204 may be non-contiguous and disposed at any distance apart, depending on the application.

Figure 3A:
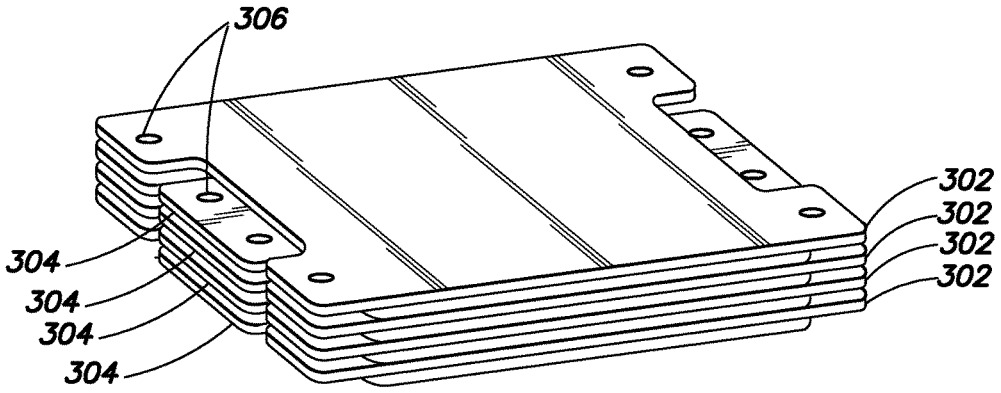
FIG. 3A is an example of a plurality of stacked materials according to aspects of the present invention.
Figure 3B:
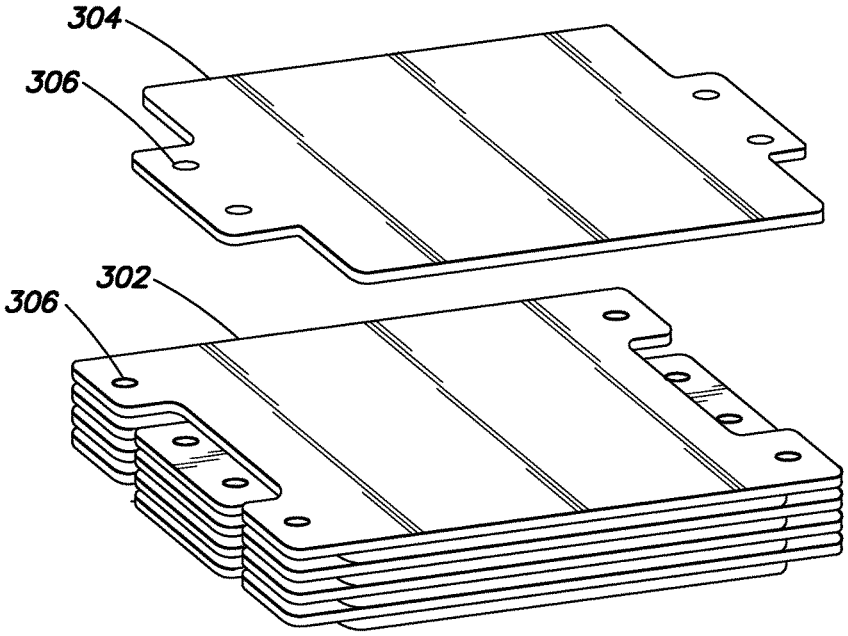
FIG. 3B is an additional example of the plurality of stacked materials depicted in FIG. 3A, according to aspects of the present invention.

Turning briefly to FIGS. 3A and 3B, there is illustrated one implementation of a plurality of stacked materials for a mechanical antenna, such as the antenna 200 shown in FIGS. 2A and 2B. As shown, the plurality of stacked materials (e.g., stacked first materials 202 and second materials 204) may include a plurality of charged plates, each plate having one or more apertures (shown generally as 306) for coupling with an actuator. For example, the plurality of charged plates can include a first plurality of plates having a positive embedded electric charge (positive plates 302) and a second plurality of plates having a negative embedded electric charge (negative plates 304). In one example, the first materials 202 shown in FIG. 2A may include the plurality of positive plates 302, and the second materials 204 shown in FIG. 2A may include the plurality of negative plates 304. Each plate 302, 304 is configured to permit independent actuation (e.g., displacement) despite the micro-dimensions of the stack. FIGS. 3A and 3B show a stacking configuration in which the positive plates 302 are alternated with the negative plates 304. As discussed herein, plates may be displaced individually or in one or more selected groupings by an actuator, such as the actuator 206 shown in FIG. 2A. In further embodiments, it is appreciated that rotational movement of the plurality of stacked materials may be used to generate a magnetic dipole.

Returning to FIGS. 2A and 2B, although depicted as including a plurality of elastic structures (e.g., springs 210) coupled to each of the plurality of first materials 202 and the plurality of second materials 204, in various additional embodiments, the actuator 206 may be configured to displace a subset of the first materials 202, and/or second materials 204 in the stacked formation in response to an electrostatic, electromagnetic, pneumatic, hydraulic, seismic, and/or any other suitable force. For example, the actuator 206 may include one of an electrostatic source, an electromagnetic source, a pneumatic source, a hydraulic source, and a seismic source, such as a fixed mechanical or electrical motor.

For example, in one implementation the mechanical antenna 200 operates as a transducer configured to translate vibrational movement of a seismic source into low frequency signal transmissions. For instance, the seismic source may include a measured device, such as a generator. In such an implementation, the mechanical antenna 200 is attached to the measured device and configured to move the plurality of first materials 202 relative to the plurality of second materials 204 in response to vibration of the measured device. Kinematic motion of the first and/or second materials 202, 204, as a result of the collected vibrations, generates a monopole current that effectively acts as a direct transduction mechanism between vibration and electromagnetic domains. In this regard, the mechanical antenna 200 can be configured to transmit status information, such as an emergency beacon or operational data, in response to vibration of the measured device. This allows environmental information to be passively transmitted without requiring intermediate steps such as sensing, processing, and RF transmission.

In other embodiments, the antenna 200 may further include a controller 214 in communication with the actuator 206 and configured to monitor the operation of the antenna 200 and instruct the actuator 206 to displace a subset of the plurality of first materials 202 relative to the plurality of second materials 204. For example, one or more control signals may be provided to the actuator 206, responsive to detecting movement of a measured device. The controller 214 may include a single controller; however, in various other embodiments the controller 214 may consist of a plurality of controllers and/or control subsystems, which may include an external device, signal processing circuitry, or other control circuit. In particular, the controller 214 may include analog processing circuitry (e.g., a microcontroller) and/or digital signal processing circuitry (e.g., a digital signal processor (DSP)). For instance, the microcontroller of various embodiments may include a processor core, memory, and programmable input/output components.

In at least one embodiment, the controller 214 is coupled and in communication with one or more sensors (e.g., sensor 222) configured to monitor movement of the antenna 200, or the measured device. Responsive to receiving monitored information (e.g., sensor signals) from the one or more sensors, the controller 214 may deliver a control signal to the actuator 206 to alter operation of the antenna 200. For example, an optical sensor may direct optical radiation to and detect reflected radiation from a surface of the antenna 200 (e.g., actuator 210, or plurality of first materials 202, or plurality of second materials 204). Movement of the antenna 200 varies reflections of the radiation and enables the optical sensor to track the movement of the antenna 200. Accordingly, in certain embodiments monitored movement of the mechanical antenna 200 can also be fed to controller 214 to self-regulate operation of the antenna 200.

It is also appreciated that various embodiments of the mechanical antenna 200 discussed herein may include a first material and a second material configured to efficiently match an impedance of the mechanical antenna 200 and an impedance of a transmission system, or other system electronics (e.g., system components 216) connected with the mechanical antenna 200. Impedance matching permits the generation of efficient electromagnetic inputs. It is appreciated that mechanical systems, such as the mechanical antenna 200 shown in FIG. 2A, naturally operate at lower frequencies than electronic coils and other electromagnetic systems and therefore offer a more simplified system to impedance match.

As discussed above, in various embodiments, the mechanical antenna 200 is configured to passively generate low frequency signals, such as baseband signals, as a result of kinematic motion. Given the long wavelengths of signals at low frequencies (for example 1500 km @ 200 Hz), efficient propagation in the near field is critical to maximize a transmitted signal for detection. As a result of generation of a perfect monopole, the near field propagation of the mechanical antenna 200 of various embodiments is dominated by $1/r^2$ behavior, as opposed to $1/r^3$ behavior, which is typical of inductive coils used for magnetic transduction. Accordingly, the mechanical antenna 200 permits an improved signal to noise ratio for the same transmitter volume and power output when compared with conventional systems. For example, at 20 kHz and a range of a few kilometers, the mechanical antenna array field may be an order of magnitude (e.g., 20 dB) larger than the theoretical capability of a coil antenna with the same volume. Furthermore, coil antennas are limited by temperature restraints of corresponding insulation. When the power to the coil is restricted to match the expected losses of the mechanical antenna, the field of the mechanical antenna 200 may be four orders of magnitude (e.g., 80 dB) larger than that of an optimized coil of the equivalent size.

Figure 4:
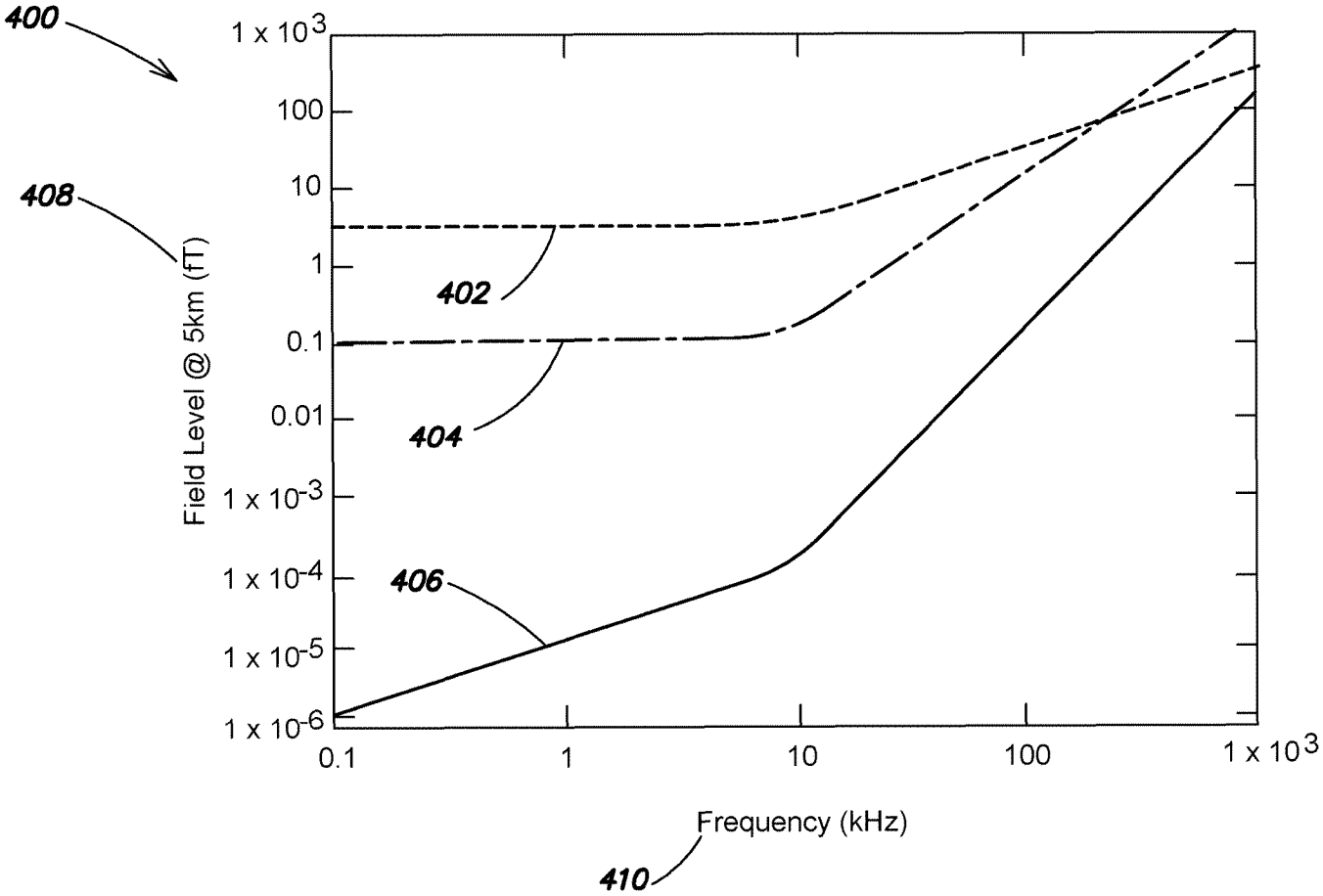
FIG. 4 is a plot of achieved field level of the example mechanical antenna illustrated in FIGS. 2A and 2B, according to aspects of the present invention.

FIG. 4 shows a plot 400 comparing the achieved field level for an electret-based mechanical antenna, according to an embodiment, and an optimal inductive coil. Plot 400 includes a vertical axis 408 indicating a field level at 5 km (fT) and a horizontal axis 410 indicating frequency (kHz). As shown in FIG. 4, the electret-based antenna demonstrates a greater field level (shown as trace 402) at lower frequencies than a coil run at its thermal limit (shown as trace 404). The electret based antenna demonstrates a field based level many magnitudes greater than the coil based antenna when the coil is restricted to the same power output (shown as trace 406) as the electret based mechanical antenna of an embodiment.

Figure 5:
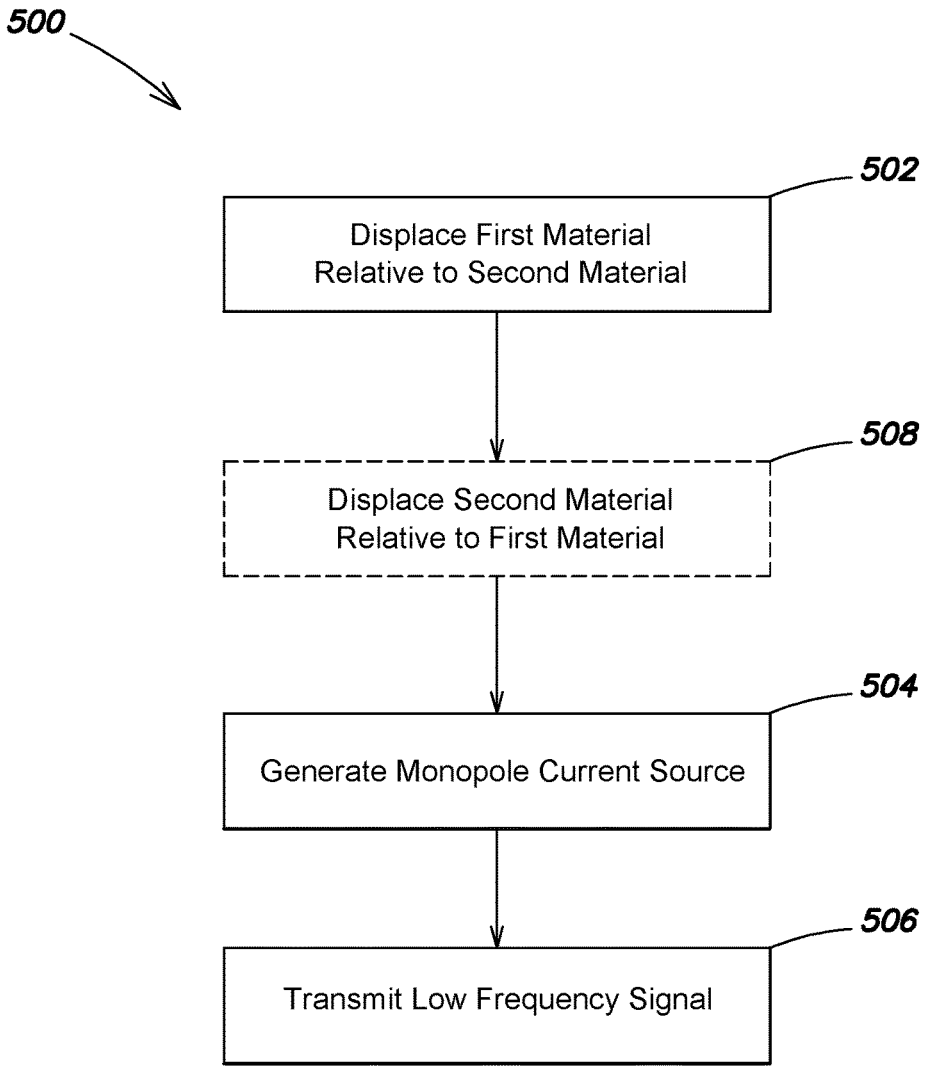
FIG. 5 is a process flow of an example method for transmitting electromagnetic energy, according to aspects of the present invention.

As described above with reference to FIGS. 1, 2A-2B, and 3A-3B, several embodiments perform processes that transmit electromagnetic energy. In some embodiments, these processes are executed by a mechanical antenna, such as the antenna 100 described above with reference to FIG. 1, or the mechanical antenna 200 described with reference to FIGS. 2A and 2B. One example of such a process is shown in FIG. 5. In various embodiments, the process 500 includes acts of displacing a first material relative to a second material, generating a monopole current, and transmitting a low frequency signal. In further embodiments, the process 500 may additionally include displacing the second material relative to the first material.

Referring to act 502, the process 500 may include displacing a first material having first embedded electric charge carriers relative to a second material having second embedded electric charge carriers. For instance, the first material may include the first material 102 shown in FIG. 1, and the second material may include the second material 104 also shown in FIG. 1. Kinematic motion of the embedded electric charge carriers, which are immobilized in the first and second materials, generates a line or loop current which may be used to transmit electromagnetic energy. In certain embodiments, displacing the first material includes actuating the first material in a first linear direction with an actuator coupled to the first material. Displacement of the first and second material in opposite directions may effectively double the realized current. Accordingly, in certain embodiments the process 500 may further include displacing the second material relative to the first material in a second linear direction (act 508).

In various embodiments, displacing the first material and/or second material includes separating the first and second material, rotating the first and/or second material, or linearly translating the first and/or second material. While in one embedment, the first and second material may each include a highly resistive dielectric, such as an electret, in other embodiments the first and second materials may include capacitor plates.

As discussed above, responsive to displacing the first material relative to the second material, the process 500 may include generating a monopole current (act 504). Physical (i.e., kinematic) displacement of the first material, and consequent movement of the embedded electric charge carriers trapped therein, is equivalent to a line current. However, physical displacement of the first material, and/or physical displacement of the second material, does not create a return current path (as would be the case in a conventional magnetic coil). Accordingly, generation of a monopole current according to various aspects and embodiments avoids many of the noted inefficiencies of conventional low frequency antennas. In response to generation of a monopole current, the process 500 may then include sending and/or receiving electromagnetic energy, such as a low frequency signal (act 506).

In a particular implementation, the process 500 can include translating vibrational movement of a device being measured (e.g., a generator) into a transmitted low frequency signal. In such an implementation, the process 500 includes displacing the first material relative to the second material in response to measuring vibrations of the measured device. Kinematic motion of the materials as a result of the collected vibrations generates a monopole current and a corresponding field, which can be used to transmit electromagnetic energy. In this regard, transmitting a low frequency signal may include transmitting status information, such as an emergency beacon or operational data, in responsive to measuring the vibrations of the measured device. Vibrations of the measured device may be measured directly (e.g., by one or more sensors), or passively (e.g., corresponding displacement of the first material and/or second material). Although described herein primarily in the context of low frequency signals, in various embodiments the process 500 may also include transmitting a high frequency signal, or a signal of any other frequency suitable for a given application.

While discussed in certain embodiments as including the acts of displacing a first material and/or second material relative to the other, in other examples, the mechanical antenna may include a plurality of stacked materials, and, accordingly, the acts of displacing the first material and/or second material may include displacing a subset of a plurality of first materials and/or a subset of a plurality of second materials. In particular, each first material of the plurality of first materials, and each second material of the plurality of second materials, may include a highly resistive dielectric embedded with electric charge carriers, such as an electret. Relative to displacing a single first or second material, displacement of a subset of a plurality of first materials (and/or second materials) may permit increases in the magnitude of the generated monopole current. As discussed above, generation of the monopole current creates a corresponding field, which may then be used to transmit a desired low frequency signal.

Similar to the acts 502, 508 discussed with reference to FIG. 5, in various embodiments displacing the subset of the plurality of first materials may include displacing the subset of the first materials in a linear direction with an actuator coupled to at least the subset of the first materials. While in one embodiment the actuator may include a plurality of elastic structures (e.g., springs) positioned to apply a spring force, in other implementations the actuator may displace the plurality of first materials based on any of an electrostatic, an electromagnetic, a pneumatic, a hydraulic, and/or a seismic force. In further embodiments, the subset of the plurality of second materials may be displaced in a second linear direction substantially opposite to the first linear direction, in a similar manner. While discussed as including displacing the subset of first materials or second materials in a linear fashion, in various other embodiments displacing the subset of first materials and/or second materials may include separating, rotating, or translating the subset of first materials and/or second materials in any other manner.

As described above with reference to FIGS. 1, 2A-2B, and 3A-3B, several embodiments may also perform processes that receive electromagnetic energy. In some embodiments, these processes are executed by a mechanical antenna, such as the antenna 100 described above with reference to FIG. 1. In one example, the process includes receiving a signal having an associated electromagnetic field, and generating a mechanical force in an antenna having a first highly resistive dielectric embedded with electric charge carriers and a second highly resistive dielectric embedded with electric charge carriers. Generating the mechanical force can include imparting the electromagnetic field on the embedded electric charge carriers in the first and second dielectric. In various embodiments, the process may additionally include, measuring the generated mechanical force to interpret the received signal. The induced force produced on the electric charge carriers in the first and second dielectric will be imparted on the structure which can then be measured by directly measuring the force applied to the structure, its displacement, or other physical attributes of the structure. Flux concentration mechanisms can be added to the structure to enhance the forces applied to the mass and improve the sensitivity of the antenna during receiving operations. In various embodiments, measuring the generated mechanical force includes measuring the displacement of the first highly resistive dielectric relative to the second highly resistive dielectric. However, it is appreciated that measuring the generated mechanical force is not limited to kinematic motion of the first and second highly resistive dielectrics, and may include torques or other mechanical forces. Signals received by the mechanical antenna may include low and/or high frequency signals.

Accordingly, provided herein is an efficient compact mechanical antenna capable of transmitting and receiving low frequency signals without the significant losses that conventional antennas suffer. Embodiments of systems and methods disclosed herein may have applications in various fields, such as radio communication and navigation as well as various medical, meteorological and military applications. In particular, embodiments may be used to communicate information to or from a system that is enclosed by a conducting material, for example, salt water, metal containers, buildings, soil, tissue, and so forth. For example, embodiments may provide a long range portable transmitter for secure and hardened theater level communications and navigation systems that do not require a satellite (e.g., GPS) infrastructure. Other examples of embodiments include small covert low frequency antennas and collection systems for various data exfiltration missions.

Having described above several aspects of at least one embodiment, it is to be appreciated various alterations, modifications, and improvements will readily occur to those skilled in the art. Such alterations, modifications, and improvements are intended to be part of this disclosure and are intended to be within the scope of the disclosure. Accordingly, the foregoing description and drawings are by way of example only, and the scope of the disclosure should be determined from proper construction of the appended claims, and their equivalents.

What is claimed is:

1. A mechanical antenna comprising:

a first material having first embedded electric charge carriers;

a second material having second embedded electric charge carriers; and an actuator coupled to at least one of the first material and the second material, the actuator being configured to generate a monopole current and transmit a low frequency signal by causing kinematic motion of the first material relative to the second material.

2. The antenna of claim 1, wherein the actuator includes one of an electrostatic source, an electromagnetic source, a pneumatic source, a hydraulic source, and a seismic source, the actuator being further configured to displace the first material in a first linear direction relative to the second material.

3. The antenna of claim 2, wherein the actuator is further configured to displace the second material in a second linear direction relative to the first material, and wherein the second linear direction is substantially opposite to the first linear direction.

4. The antenna of claim 1, wherein the actuator includes one of an electrostatic source, an electromagnetic source, a pneumatic source, a hydraulic source, and a seismic source, wherein in causing kinematic motion of the first material relative to the second material, the actuator is configured to rotate the first material relative to the second material.

5. The antenna of claim 1, further comprising:

at least one sensor positioned to measure movement of the mechanical antenna; and a controller in electrical communication with the actuator and the sensor, the controller being configured to induce the actuator to displace the first material in a first linear direction relative to the second material responsive to receiving a sensor signal from the sensor.

6. The antenna of claim 1, wherein the actuator is further configured to cause the kinematic motion of the first material relative to the second material to generate the monopole current responsive to receiving a baseband seismic input from one or more seismic sources.

7. The antenna of claim 1, wherein the first material includes a first highly resistive dielectric and the second material includes a second highly resistive dielectric, and each of the first highly resistive dielectric and the second highly resistive dielectric include an electret.

8. The antenna of claim 1, wherein the first material and the second material are non-contiguous.

9. The antenna of claim 1, wherein each of the first material and the second material are further configured to mechanically match an impedance of the mechanical antenna and an impedance of system electronics coupled to the mechanical antenna.

10. The antenna of claim 1, wherein the low frequency signal includes a baseband signal having a wavelength within a frequency wavelength range of 1 Hz-100 kHz.

11. A mechanical antenna comprising:

a plurality of first materials each having first embedded electric charge carriers;

a plurality of second materials each having second embedded electric charge carriers, the plurality of first materials and the plurality of second materials being stacked so as to alternate between the first materials and the second materials; and an actuator coupled to at least a subset of first materials of the plurality of first materials, the actuator being configured to generate a monopole current and transmit a low frequency signal by causing kinematic motion of the subset of first materials relative to the plurality of second materials.

12. The antenna of claim 11, wherein the actuator includes one of an electrostatic source, an electromagnetic source, a pneumatic source, a hydraulic source, and a seismic source, the actuator being further configured to displace the subset of first materials in a first linear direction relative to the plurality of second materials.

13. The antenna of claim 12, wherein the actuator is further coupled to at least a subset of second materials of the plurality of second materials, and the actuator being further configured to displace the subset of second materials in a second linear direction relative to the plurality of first materials, and wherein the second linear direction is substantially opposite the first linear direction.

14. The antenna of claim 11, wherein the actuator is further configured to selectively displace individual ones of the subset of first materials.

15. The antenna of claim 11, wherein each first material of the plurality of first materials includes a first highly resistive dielectric and each second material of the plurality of second materials includes a second highly resistive dielectric, and each of the first highly resistive dielectric and the second highly resistive dielectric includes an electret.

16. A method comprising:

displacing a first material having first embedded electric charge carriers relative to a second material having second embedded electric charge carriers;

generating a monopole current responsive to displacement of the first material; and transmitting a low frequency signal based at least in part on the monopole current.

17. The method according to claim 16, wherein displacing the first material relative to the second material includes displacing the first material in a first linear direction with an actuator coupled to the first material.

18. The method according to claim 17, further comprising displacing the second material relative to the first material in a second linear direction, wherein the second linear direction is substantially opposite to the first linear direction.

19. The method according to claim 16, wherein displacing the first material relative to the second material includes rotating the first material relative to the second material, and wherein the first material is a first highly resistive dielectric and the second material is a second highly resistive dielectric.

20. The method according to claim 16, wherein transmitting the low frequency signal further includes transmitting a baseband signal having a wavelength within a frequency range of 1 Hz-100 kHz.

* * * * *